United States Patent [19]

Goetschius

[11] Patent Number: 4,838,342

[45] Date of Patent: Jun. 13, 1989

[54] ELEMENT BASKET ASSEMBLY FOR HEAT EXCHANGER

[75] Inventor: Gary C. Goetschius, Wellsville, N.Y.

[73] Assignee: The Air Preheater Company, Inc., Wellsville, N.Y.

[21] Appl. No.: 200,887

[22] Filed: Jun. 1, 1988

[51] Int. Cl.[4] ..... F28D 19/04

[52] U.S. Cl. ..... 165/10; 165/8

[58] Field of Search ..... 165/8, 10

[56] References Cited

U.S. PATENT DOCUMENTS

| | | | |
|---|---|---|---|
| 3,314,472 | 4/1967 | Krumm et al. | 165/10 |
| 3,379,240 | 4/1968 | Woolard et al. | 165/10 |
| 4,552,204 | 11/1985 | Bellows | 165/10 |
| 4,557,318 | 12/1985 | Bellows | 165/10 |
| 4,558,732 | 12/1985 | Bellows | 165/8 |
| 4,561,492 | 12/1985 | Bellows | 165/8 |
| 4,606,400 | 8/1986 | Rhoes | 165/10 |
| 4,789,024 | 12/1988 | Muscato | 165/10 |

FOREIGN PATENT DOCUMENTS

| | | | |
|---|---|---|---|
| 2377599 | 9/1978 | France | 165/10 |
| 2377600 | 9/1978 | France | 165/10 |

*Primary Examiner*—Albert W. Davis, Jr.
*Attorney, Agent, or Firm*—William W. Habelt

[57] ABSTRACT

A peripheral element basket assembly (30) for installation in the radially outward portion of the rotor 12 of a rotary regenerative heat exchanger (2) comprised of a plurality of heat transfer element plates (32) stacked in an array between a first flanged flat end plate (34) and a second arcuate end plate (36) disposed at opposite ends of the stacked array of heat transfer element plates (32). Upper and lower side straps (40,42 and 50,52) run along opposite sides of the stacked array of heat transfer element plates, to interconnect the first and second end plates (34,36) to form the frame of the element basket housing the heat transfer element plates. Blanking plates (60,62) are welded to the upper and lower regions respectively of the arcuate end plate (36) to extend outwardly superadjacent and subadjacent the foreshortened heat transfer element sheets (32') disposed adjacent the arcuate end plate (36).

4 Claims, 3 Drawing Sheets

ELEMENT BASKET ASSEMBLY FOR HEAT EXCHANGER

BACKGROUND OF THE INVENTION

The present invention relates to heat transfer element baskets and, more specifically, to an assembly of heat absorbent plates in a basket for use in a heat exchanger wherein heat is transferred by means of the plates from a hot heat exchange fluid to a cold heat exchange fluid. The present invention has particular application in heat transfer apparatus of the rotary regenerative type wherein the heat transfer element is heated by contact with a hot gaseous heat exchange fluid and thereafter brought in contact with a cool gaseous heat exchange fluid to which the heat transfer element gives up its heat.

One type of heat exchange apparatus commonly used for gas-to-gas heat exchange in the process industry and for gas-to-air heat exchange on utility steam generators is the well-known rotary regenerative heat exchanger. Typically, a rotary regenerative heat exchanger has a cylindrical rotor divided into sector-shaped compartments in which are disposed a mass of heat transfer element which, as the rotor turns, is alternately exposed to a stream of heating gas and then upon rotation of the rotor to a stream of cooler air or other gaseous fluid to be heated. The heat absorbent mass typically comprises a plurality of heat transfer element basket assemblies mounted in sector shaped compartments. Each of the heat transfer element basket assemblies houses a plurality of heat transfer plates which when exposed to the heating gas absorb heat therefrom and then when exposed to the cool air or other gaseous fluid to be heated, the heat absorbed from the heating gas by the heat transfer plates is transferred to the cooler gas.

Most commonly, such an element basket comprises a frame-like housing having a plurality of sheet-like heat transfer plates disposed therein. Typically, the element basket housing comprises a frame formed of a pair of spaced plate-like end members held together by paired side straps interconnecting the end members along the sides thereof such as shown in U.S. Pat. Nos. 3,314,472, 4,561,492 and 4,606,400. A plurality of heat transfer plates are stacked in closely spaced relationship within the basket housing to provide a plurality of passageways between adjacent plates through which the heat exchange fluids pass. The side straps which interconnect the spaced end members typically extend in pairs along the opposite sides of the stacked array of heat exchange elements. On each side of the heat exchange element is a first side strap extending between the upper regions of the spaced end members and a second side strap extending between the lower region of the end members in spaced, parallel relationship to the first side strap. The side straps may be flanged inwardly along the longitudinal edge lying at the edge of the basket assembly to provide a retaining surface for preventing the heat transfer plates from falling out of the open ends of the element basket as shown in U.S. Pat. No. 3,314,472.

Typically, a plurality of retaining bars are welded between the end plates across the top and bottom ends thereof to further assist in keeping the heat transfer element plates from falling out of the open ends of the element basket. The retaining bars may merely be disposed to lie across the top and bottom edges of the heat transfer element plates as shown in U.S. Pat. No. 4,561,492. Alternatively, in order to provide a shorter basket for a given plate height, the retaining bars may be disposed within recesses cut in the top and bottom edges of the heat transfer element plates as shown in U.S. Pat. No. 4,606,400.

The retaining bars also serve as structural members for supporting lifting means to facilitate handling of the assembled element baskets and, in particular, to facilitate the installation and removal of the element baskets from the heat exchanger. Typically, the lifting means comprises a pair of spaced aparted holes formed in a centrally located retaining bar as shown in U.S. Pat. No. 4,552,204, or a pair of spaced aparted pins integral with and passing through a centrally located retaining bar as shown in U.S. Patent 4,557,318. When the lifting means comprises a pair of holes in the aforementioned U.S. Pat. No. 4,552,204, the element basket is lifted by means of a pair of clevis means which are disposed to span the central retaining bar about each lifting hole. Each clevis is engaged to the retaining bar by a pin which is passed through the lifting hole and each side of the clevis spanning the bar. When the lifting means comprises a pair of lifting pins as in the aforementioned U.S. Pat. No. 4,557,318, the element basket is lifted by means of a pair of lifting lugs which simply grasp the pins extending through the central retaining bar.

Generally, such element baskets are in the configuration of a trapezoidal frustrum. However, the element basket disposed in the radialy outward sections of the sector shaped compartments of the cylindrical rotor necessarily can not be of a trapezoidal cross-section due to the curvature of the surrounding rotor. If these peripheral baskets were of a true trapezoidal cross section there would exist a gap between the radially outward end of the basket and the cylindrical wall of the surrounding rotor. Such a gap is undesirable as gas and air flowing through the rotor and passing through the gap would bypass the heat transfer surface housed in the baskets thereby reducing the efficiency of the heat exchanger. Additionally, the existence of the gap means the rotor is not fully filled with heat transfer surface.

Accordingly, it is customary in the prior art to construct the peripheral baskets in the form of a frustrum having a cross-section shaped as a trapezium, i.e., as a quadrilateral having no parallel sides, rather than as a trapezoid wherein the end members of the basket are parallel to each other. Further, it is customary to provide an arcuate end member as the radially outward end of such a peripheral basket with the arcuate member having a curvature commensurate with the curvature of the surrounding rotor.

In such peripheral baskets, the element sheets disposed within the basket at the radially outward extend thereof must be foreshortened due the curvature of the outer end member. As these foreshortened elements sheet do not extend across the entire width of the basket, they are not adequately held in place by a tight fitting between the side straps as in the case of the fully extending sheets in the remainder of the basket. Therefore, in order to prevent these foreshortened sheets from becoming too loose and shifting around or flexing under the force of high velocity jets of cleaning media during soot blowing or water washing, it is common practice in the prior art to install retaining clips on each of these foreshortened element sheets in peripheral basket assemblies. Each clip must be hand installed and welded to the arcuate end member in such a position as to engage one of the foreshortened element sheets. As two clips must be provided for each foreshortened element sheet, one at the top side of the basket and one at the bottom side of the basket, the process of assembling such peripheral basket assemblies is labor intensive and time consuming.

SUMMARY OF THE INVENTION

In the peripheral element basket assembly of the present invention, a plurality of heat transfer element sheets are disposed in a stacked array between first and second end members disposed at opposite ends of the stacked array of the heat transfer element plates in abutting relationship therewith and interconnected by one or more side straps welded to and extending between the end members. The radially outward end member is preferably arcuate in shape, having a curvature substantially commensurate with the curvature of the cylindrical wall of the rotor in which the peripheral element basket is to be utilized.

In accordance with the present invention, a pair of blanking plates are installed in the peripheral element basket assembly of the present invention adjacent the outward end thereof so as to abut the upper and lower edges of the foreshortened element sheets as a means of holding the foreshortened element sheets within the basket. One of the pair of blanking plates is welded to the upper edge of the outward end plate so as to extend across the upper edge of the foreshortened element sheets and the other of the pair of blanking paltes is welded to the lower edge of the outward end plate so as to extend across the lower edge of the foreshortened element sheets.

DESCRIPTION OF A PREFERRED EMBODIMENT

Figure 1:
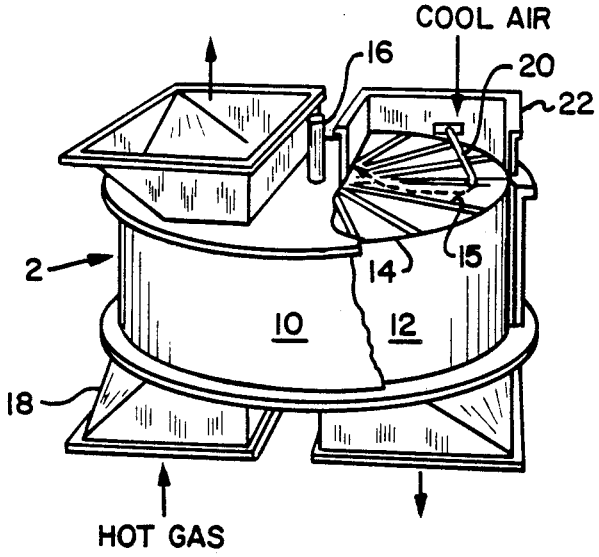
FIG. 1 is a perspective view of a rotary regenerative heat exchanger.
Figure 2:
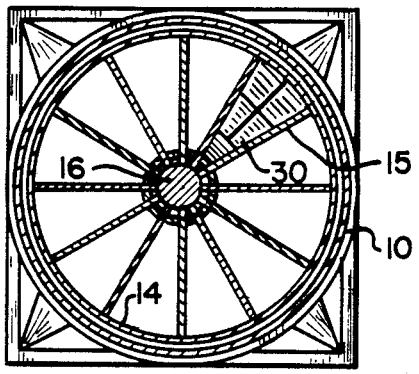
FIG. 2 is a plan view of the rotary regenerative heat exchanger of FIG. 1 taken along line 2—2.

Referring now to the drawings and, more particularly to FIG. 1, there is depicted therein a regenerative heat exchanger apparatus 2 in which the heat transfer element basket assemblies of the present invention may be utilized. The rotary regenerative heat exchanger 2 comprises a housing 10 enclosing a rotor 12 wherein the heat transfer element basket assemblies of the present invention are carried. The rotor 12 comprises a cylindrical shell 14 connected by radially extending diaphragms 15 to the rotor post 16. A heating fluid enters the housing 10 through duct 18 while the fluid to be heated enters the housing 10 from the opposite end thereof through duct 22.

The rotor 12 is turned about its axis by a motor connected to the rotor post 16 through suitable reduction gearing, not illustrated here. As the rotor 12 rotates, the heat transfer element, termed sheets or plates, carried within the element basket assemblies 30, disposed within the rotor in the sector shaped compartments formed by the radially extending diaphragms 15, are first moved in contact with the heating fluid entering the housing through the duct 18 to absorb heat therefrom and then into contact with the fluid to be heated entering the housing through duct 22. As the heating fluid passes over the heat transfer element plates, the heat transfer element plates absorb heat therefrom. As the fluid to be heated subsequently passes over the heat transfer element plates, the fluid absorbs from the heat transfer element plates the heat which the plates had picked up when in contact with the heating fluid.

Rotary regenerative heat exchangers are often utilized as air preheaters wherein the heat absorbent element serves to transfer heat from the hot flue gases generated in a fossil fuel-fired furnace to ambient air being supplied to the furnace as combustion air as a means of preheating the combustion air and raising overall combustion efficiency. Very often, the flue gas leaving the furnace is laden with particulate generated during the combustion process. This particulate has a tendency to deposit on heat transfer element plates particularly at the cold end of the heat exchanger where condensation of any moisture in the flue gas may occur. In order to provide for periodic cleaning of the heat transfer element disposed within the element basket assemblies, the heat exchanger is provided with a cleaning nozzle 20 disposed in the passage for the fluid to be heated adjacent the cold end of the rotor 12 and opposite the open end of the heat transfer element basket assemblies. The cleaning nozzle 20 directs a high pressure cleaning fluid, typically steam, water, or air, through the plates as they rotate slowly while the nozzle itself sweeps across the end face of the rotor. As the high pressure fluid passes over the heat transfer element plates to vibrate so as to jar loose flyash and other particulate deposits clinging thereto. The loosened particulate is then entrained in the high pressure stream and carried out of the rotor.

The heat exchange material carried in the rotor 12 comprises a mass of metallic heat transfer element plates, also termed sheets, commonly formed with corrugations or undulations such that when the plates are placed in abutting relationship in a stack array, a series of internal passages are provided through which the heating fluid and cooling fluid flow. The plates are typically assembled in an quadrilateral-shaped frame, termed an element basket, that houses the stacked array of plates with the individual plates held in their stacked order so that they may be handled as an integral assembly for placement within the sector-shaped compartments within the rotor of the heat exchanger.

Figure 3:
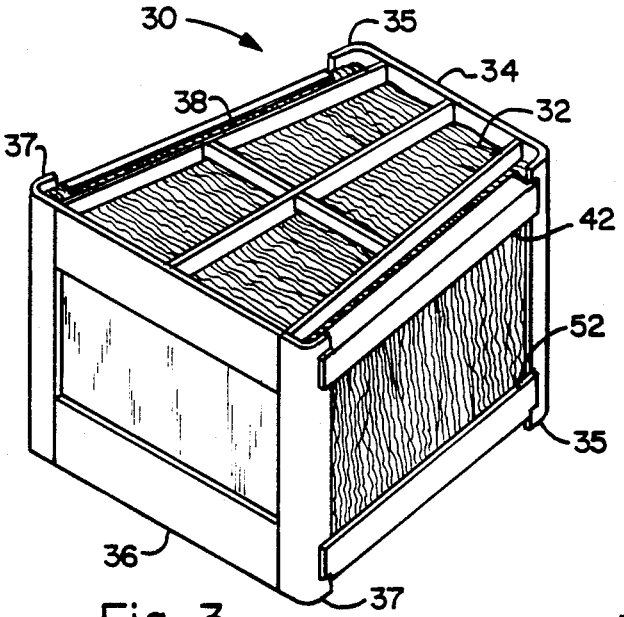
FIG. 3 is a perspective view of an element basket assembly designed in accordance with the present invention.

As illustrated in FIG. 3, the element basket assembly 30 comprises a plurality of heat transfer element plates 32 juxtaposed in spaced relationship to provide a stacked array of plates having a plurality of flow passages therebetween so as to provide a flow path through which heat exchange fluid may pass in heat exchange relationship with the plates 32. The plates 32 are usually thin metal sheets capable of being rolled or stamped to a desired configuration, however, the invention is not limited necessarily to the use of metallic sheets. The plates 32 may be of various surface configuration such as, but not limited to, a flat surface or a corrugated or undulated surface, or a combination thereof with the flat plates stacked alternately between corrugated or undulated plates. In any case, the stacked array of element plates is disposed between a first end member 34 at one end thereof and a second end member 36 at the other end thereof. The members 34 and 36 abut the ends of the stacked array of heat transfer element plates and are held in position by means of side straps 40, 42 and 50, 52 which are disposed along opposite sides of the stacked array of heat transfer element plates at the upper and lower edges of the plates, respectively, to interconnect the spaced-apart first and second end members 34 and 36.

It is to be understood that the end plates 34 and 36 may be, but need not be, full plates. Rather, one or both of the end plates 34 and 36 may be formed of two spaced vertical side members 82 and 84 interconnected by a horizontally disposed transversely extending upper member 86 and a horizontally disposed transversely extending lower member 88. These four members 82, 84, 86 and 88 are welded together at their respective intersections to form a substantially rectangular end plate as best seen in FIG. 3.

The side straps 40 and 42 are welded at one end to the upper right and upper left corners, respectively, of the end member 34 and are welded at their other end to the upper right and upper left corners of the opposite end member 36. Similarly, the side straps 50 and 52 are welded at one end to the lower right and lower left corners, respectively, of the end plate 34 and are welded at their other end to the lower right and lower left corners of the opposite end plate 36.

As best seen in FIG. 3, the side straps 40, 42, 50 and 52, are preferably flanged along their longitudinal edges lying at the upper and lower edges of the basket assembly. The flanges 41 and 43 extend inwardly from the inside longitudinal edges of the side straps 40 and 42, respectively, superadjacent the upper edges of the heat transfer element plates 32. Similarly, the flanges 51 and 53 extend inwardly from the inside longitudinal edges of the side straps 50 and 52, respectively, subadjacent the lower edges of the heat transfer element plates 32. The upper flanges 40 and 42 and the lower flanges 50 and 52 provide retaining surfaces along the upper and lower edges of the basket assembly to prevent the heat transfer element plates 32 stacked therein from falling out of the open ends of the basket assembly 30 during transport, handling, or installation. Additionally, a plurality of element retaining bars 38 of a low height may be tack-welded betweeen the end members 34 and 36 at the open top and open bottom of the element basket assembly 30 intermediate the side straps in order to further assist in preventing the heat transfer element plates 32 stacked therein from falling out the open ends of the basket element assembly 30. The retaining bars 38 are preferably provided with lifting means, such as disclosed in U.S. Pat. Nos. 4,552,204 and 4,557,318, for facilitating installation and removal of the basket assembly from the rotor.

Figure 4:
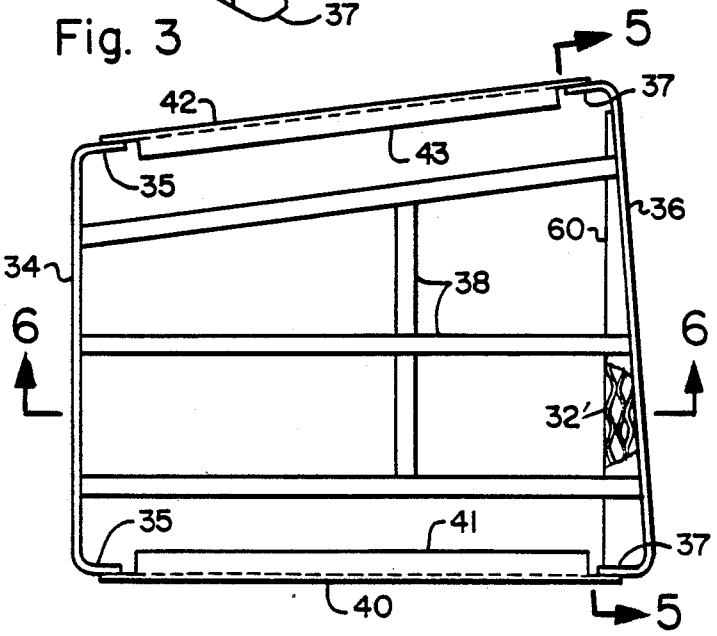
FIG. 4 is an enlarged plan view looking down on the element basket assembly of FIG. 3 with blanking plates installed in the element basket assembly.

As noted hereinbefore, for a peripheral element basket assembly, the second end member 36, i.e., the radially outward end member of the basket assembly 30 which lies adjacent the cylindrical wall of the shell 14 when installed in the rotor 12, is arcuate in shape as best seen in FIG. 4. Most advantageously, the curvature of the arcuate end member 36 is commensurate with the curvature of the cylindrical wall of the shell 14. Due to this curvature of the arcuate end member 36, the heat transfer element sheets 32' in the outer region of the peripheral element basket assembly 30, i.e., the portion of the basket lying adjacent to and within the segment subscribed by the curvature of the arcuate end member 36, must be foreshortened in length. The element sheets 32' are therefore shorter than the remainder of the element sheets 32 which cross the entire width of the basket assembly 30 between the side straps 40, 50 and 42, 52.

Figure 5:
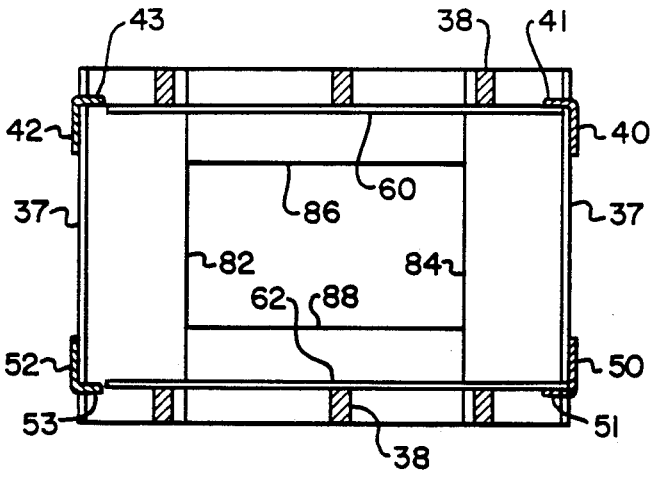
FIG. 5 is a sectional end elevational view taken along line 5—5 of FIG. 4.
Figure 6:
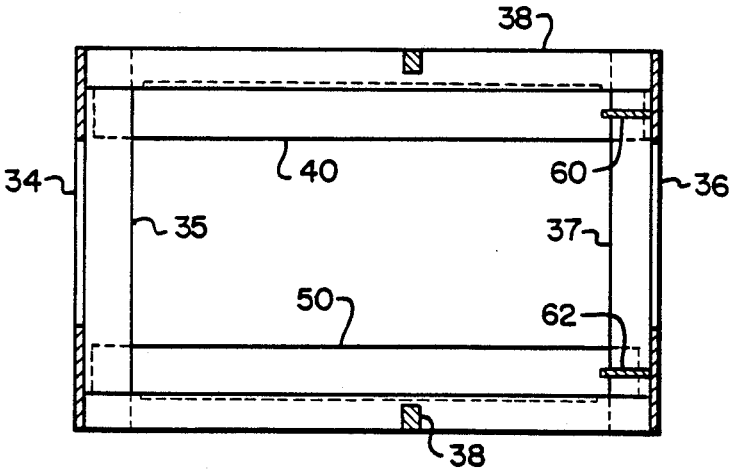
FIG. 6 is a sectional side elevational view taken along line 6—6 of FIG. 4.

As best seen in FIGS. 4, 5 and 6, in the element basket assembly of the present invention, segment shaped blanking plates 60 and 62 are installed across the upper and lower edges, respectively, of the foreshortened heat transfer element sheets 32' adjacent the arcuate end member 36. In this manner, the foreshortened heat transfer elements 32' are sandwiched between the blanking plates 60 and 62 thereby loosely but securely held in place within the outer region of the peripheral element basket assembly without the use of engagement clips as commonly required in prior art peripheral element basket assemblies as hereinbefore discussed. For simplicity of illustration, the peripheral element basket assembly of the present invention is shown in FIGS. 4, 5 and 6 with the heat transfer element plates 32 and 32' removed (except for a single representative foreshortened plate shown in FIG. 6), in order to illustrate with greater clarity the element basket frame of the peripheral element basket assembly.

To manufacture the peripheral element basket assembly 30 of the present invention as shown in FIGS. 4, 5 and 6, the first and second end members 34 and 36 are first assembled by welding together their respective flanged side members 82 and 84 and upper and lower transverse members 86 and 86 to form a substantially rectangular flanged end plates, with the smaller inner end plate 34 being substantially flat with side flanges 37 extending outwardly therefrom and with the larger outer end plate 36 being arcuate with side flanges 39 extending outwardly therefrom.

The construction of the basket frame is then undertaken by welding the side straps 40 and 42 to the outer side surface of one flange 35 of the smaller inner end plate 34 so as to extend outwardly, respectively, from the plate 34 at the upper and lower lateral regions thereof and by welding the side straps 50 and 52 to the outer side surface of the outer flange 35 of the smaller inner end plate 34 so as to extend outwardly, respectively, from the plate 34 at the upper and lower lateral regions thereof.

At this point, the partially assembled basket frame is upended with the end plate 34 as its base, and the heat transfer element sheets 32 are stacked in side-by-side relationship to fill the basket frame with the desired number of full width sheets. This complete, the required number of foreshortened element sheets 32' are stacked atop the full width sheets with the length of the foreshortened sheets becoming progressively shorter such that the shortest of the foreshortened heat transfer element sheets lies atop the stacked array and will therefore lie adjacent the outer end plate 36 when the assembly of the basket is completed.

With the heat transfer element sheets 32 and 32' so arranged in a stacked array within the partially assembled basket frame, the arcuate end plate 36 is installed to complete assembly of the peripheral element basket assembly of the present invention. To install the arcuate end plate 36, the side straps 40 and 42 are welded to the outer side surface of one flange 37 of the outer arcuate end plate 36 at the upper and lower regions thereof, respectively, and the side straps 50 and 52 are welded to the outer side surface of the other flange 37 of the outer arcuate end plate 36 at the upper and lower regions thereof, respectively.

The blanking plates 60 and 62 are welded to the arcuate end plate 36 at the appropriate locations prior to welding the arcuate end plate 36 to the side straps 40, 42 and 50, 52 thereby completing manufacture of the peripheral element basket assembly 30 fully filled with heat transfer element and ready for shipment and subsequent installation. As best seen in FIG. 6, the upper blanking plate 60 is welded to the arcuate end member 36 at such a location as to extend superadjacent across the upper edge of the foreshortened heat transfer element sheets 32', while the lower blanking plate 62 is welded to the arcuate end member 36 at such a location as to extend subadjacent across the lower edge of the foreshortened heat transfer element sheets 32' when the arcuate end member 36 is subsequently welded to the side straps 40, 42 and 50, 52 to complete the assembly of the peripheral element basket assembly 30.

While the heat transfer element basket assembly has been shown embodied in a rotary regenerative heat exchanger of the type wherein the mass of heat absorbent material is rotated alternately between the heating fluid and the fluid to be heated, it would be appreciated by those skilled in the art that the heat transfer element assembly of the present invention can be utilized in a number of other known heat exchange apparatus of either regenerative or recuperative type. Additionally, various stiffening member configurations, some of which have been alluded to herein, may be readily incorporated in the heat transfer basket assembly of the present invention by those skilled in the art. Therefore, it is intended by the appended claims to cover the modifications alluded to herein as well as all other modifications which fall within the true spirit and scope of the present invention as defined by said claims.

I claim:

1. An element basket assembly for use in a rotary regenerative heat exchanger, said element basket assembly of the type adapted to be housed in a cylindrical rotor shell adjacent the outer peripheral wall of the cylindrical rotor shell, said element basket assembly comprising:

a. a plurality of heat transfer element plates juxtaposed in a stacked array;

b. a basket frame surrounding said stacked array of heat transfer element plates in supporting relationship therewith, said basket frame comprising first and second end members disposed at opposite ends of stacked array of heat transfer elements in abutting relationship therewith and at least a pair of side members disposed along sides of said stacked array of heat transfer element plates interconnecting the first and second end members, the second end member defining a segment-shaped region within said basket frame adjacent the second end member; and c. a pair of blanking plates mounted to the second end member, one of said blanking plates disposed so as to extend across said segment-shaped region along the top side of the said basket frame and the other of said blanking plates disposed so as to extend across said segment-shaped region along the bottom side of said basket frame whereby that portion of the stacked array of heat transfer elements disposed within the segment-shaped region of said basket frame are held in place between said blanking plates.

2. An element basket assembly as recited in claim 1 wherein the second end member defining said segment-shaped region is arcuate with a curvature substantially commensurate with that of the outer peripheral wall of the cylindrical rotor shell.

3. An element basket assembly as recited in claim 1 wherein at least a pair of side members comprises a pair of spaced upper side straps disposed along opposite sides of said stacked array of heat transfer element plates interconnecting the upper edges of the side of the first and second end members and a pair of spaced lower side straps disposed along opposite sides of said stacked array of heat transfer element plates interconnecting the lower edges of the sides of the first and second end members.

4. An element basket assembly as recited in claim 3 wherein each of said pair of spaced side straps has a flange extending transversely inwardly therefrom superadjacent the stacked array of heat transfer element plates, and each of said pair of spaced lower side straps has a flange extending transversely inwardly therefrom subadjacent the stacked array of heat transfer element plates.

* * * * *